United States Patent [19]

Seoka et al.

[11] 4,455,367

[45] Jun. 19, 1984

[54] SILVER HALIDE COLOR PHOTOGRAPHIC LIGHT-SENSITIVE MATERIAL

[75] Inventors: Yoshio Seoka; Kozo Aoki, both of Kanagawa, Japan

[73] Assignee: Fuji Photo Film Co., Ltd., Kanagawa, Japan

[21] Appl. No.: 369,768

[22] Filed: Apr. 19, 1982

[30] Foreign Application Priority Data

Apr. 20, 1981 [JP] Japan ..... 56-59415

[51] Int. Cl.[3] ..... G03C 1/46

[52] U.S. Cl. ..... 430/505; 430/546; 430/552; 430/553

[58] Field of Search ..... 430/546, 552, 553, 505

[56] References Cited

U.S. PATENT DOCUMENTS

| | | | |
|---|---|---|---|
| 2,322,027 | 6/1943 | Jelley et al. | 430/546 |
| 4,275,145 | 6/1981 | Mikami | 430/546 |
| 4,334,011 | 6/1982 | Aoki et al. | 430/552 |
| 4,362,810 | 12/1982 | Usagawa et al. | 430/552 |

*Primary Examiner*—J. Travis Brown

*Attorney, Agent, or Firm*—Sughrue, Mion, Zinn, Macpeak & Seas

[57] ABSTRACT

A silver halide color photographic light-sensitive material containing particles of a coupler solution, comprising a cyan dye forming coupler represented by the following general formula (I)

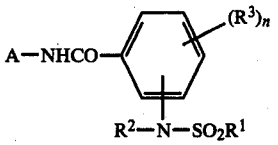

(I)

wherein A represents a cyan coupler residue, but the —NHCO— group does not bond to A in the active position of A; $R^1$ represents a substituted or unsubstituted alkyl group or a substituted or unsubstituted aryl group; $R^2$ represents a hydrogen atom or a substituted or unsubstituted alkyl group; $R^3$ represents a hydrogen atom, a halogen atom, an alkyl group or an alkoxy group; and n represents an integer of 1 to 3, and when n is 2 or more $R^3$ may be the same or different, and a coupler solvent having a dielectric constant of 2.5 to 5. The silver halide color photographic light-sensitive material provides a color image having good fastness to heat and light as well as excellent color reproducibility.

29 Claims, No Drawings

SILVER HALIDE COLOR PHOTOGRAPHIC LIGHT-SENSITIVE MATERIAL

BACKGROUND OF THE INVENTION

The present invention relates to a color photographic light-sensitive material containing particles of a novel cyan dye forming coupler solution.

When color development is carried out after a silver halide photographic light-sensitive material is exposed to light, an oxidized aromatic primary amine developing agent reacts with a dye forming coupler to form a color image. In this process, color reproduction by a subtractive process is generally utilized. In according to this process, dye images of cyan, magenta and yellow, which are complement colors of red, green and blue, respectively, are formed for reproduction of red, green and blue. For example, cyan color image forming couplers include compounds such as various phenols and naphthols.

Generally, with respect to positive type light-sensitive materials to be observed directly (e.g., color paper, color positive, or color slide, etc.), phenols are often used from the viewpoint of color reproduction. It has been desired to improve these phenols, because phenols having good color reproducibility are often inferior in the fastness of color images. However, phenols which form dye images having good fastness often do not have absorption characteristics suitable for color reproduction. In order to eliminate these drawbacks, it is necessary in the latter case that the phenols be modified so as to show absorption characteristics suitable for color reproduction without damaging the fastness of color images.

For the purpose of satisfying the above described requirements, it has been known to introduce a chlorine atom into the 6-position of 2-acylaminophenol cyan couplers, as described in U.S. Pat. No. 2,367,531. However, fastness with respect to heat of such color images shows remarkable deterioration. Furthermore, it has been known to introduce a fluorinated carbonamido group into the 2-position of 2,5-diacylaminophenol cyan couplers as described in U.S. Pat. No. 2,895,826. However, fastness with respect to light of such color images shows remarkable deterioration.

SUMMARY OF THE INVENTION

An object of the present invention is to provide a color photographic light-sensitive material possessing excellent fastness and color reproduction, which overcomes the above described drawbacks.

Another object of the present invention is to provide a novel method of incorporating a coupler in order to further improve the color reproducibility of a coupler represented by the general formula (I) and the fastness of a dye formed from the coupler.

Other object of the present invention will become apparent from the following detailed description and examples.

It has been found that the above described objects can be attained by incorporating into a silver halide photographic light-sensitive material particles of a coupler solution comprising a cyan coupler in which a sulfonamidobenzoylamino group is introduced into a nucleus of the cyan coupler and a coupler solvent having a dielectric constant of 2.5 to 5.

The photographic light-sensitive material according to the present invention has excellent characteristics in that it forms a preferred color hue for color reproduction while also providing exceptionally high fastness of color images.

Furthermore, the particles of the coupler solution according to the present invention are also advantageous in that the lowering of the density is small in case of processing with a bleaching solution having a weak oxidation ability or a fatigued bleaching solution.

More particularly, the above described objects of the present invention have been attained by a silver halide color photographic light-sensitive material containing particles of a coupler solution, comprising a cyan dye forming coupler represented by the following general formula (I):

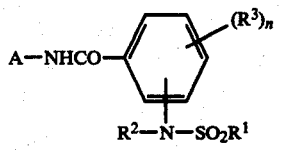

(I)

wherein A represents a cyan coupler residue, but the —NHCO— group does not bond to A in the active position of A; $R^1$ represents a substituted or unsubstituted alkyl group or a substituted or unsubstituted aryl group; $R^2$ represents a hydrogen atom or a substituted or unsubstituted alkyl group; $R^3$ represents a hydrogen atom, a halogen atom, an alkyl group or an alkoxy group; and n represents an integer of 1 to 3, and when n is 2 or more $R^3$ may be the same or different; and a coupler solvent having a dielectric constant of 2.5 to 5.

DETAILED DESCRIPTION OF THE INVENTION

In the above described general formula (I), A represents a cyan coupler residue; but the —NHCO— group does not bond to A in the active coupling position of A; $R^1$ represents a substituted or unsubstituted alkyl group having from 1 to 22 carbon atoms or a substituted or unsubstituted aryl group having 6 to 22 carbon atoms; $R^2$ represents a hydrogen atom or a substituted or unsubstituted alkyl group having from 1 to 22 carbon atoms; $R^3$ represents a hydrogen atom, a halogen atom (for example, a fluorine atom, a chlorine atom, a bromine atom, etc.), an alkyl group having 1 to 22 carbon atoms (for example, a methyl group, a butyl group, a pentadecyl group, etc.) or an alkoxy group (for example, a methoxy group, an ethoxy group, a 2-ethylhexyloxy group, etc.); n represents an integer of 1 to 3 and when n is 2 or more, $R^3$ may be the same or different.

The substituents of the alkyl groups and aryl groups represented by $R^1$ and $R^2$ are selected from a halogen atom, a nitro group, a cyano group, an aryl group (for example, a phenyl group, a naphthyl group, etc.), an alkoxy group (for example, a methoxy group, an ethoxy group, etc.), an aryloxy group (for example, a phenyloxy group, a naphthyloxy group, etc.), a carboxy group, an alkylcarbonyl group (for example, an acetyl group, a tetradecanoyl group, etc.), an arylcarbonyl group (for example, a benzoyl group, etc.), an alkoxycarbonyl group (for example, a methoxycarbonyl group, a benzyloxycarbonyl group, etc.), an aryloxycarbonyl group (for example, a phenyloxycarbonyl group, a p-tolyloxycarbonyl group, etc.), an acyloxy group (for example, an acetyloxy group, a tetradecanoyloxy group, etc.), a sulfamoyl group (for example, an N-ethylsulfamoyl group, an N-octadecylsulfamoyl group, etc.), a carbamoyl group (for example, an N-ethylcarbamoyl group, an N-methyl-N-dodecylcarbamoyl group, etc.), and acylamino group (for example, an acetylamino group, a benzamido group, etc.), a diacylamino group (for example, a succinimido group, a hydantoinyl group, etc.), a ureido group (for example, a methylureido group, a phenylureido group, etc.), an arylamino group (for example, a (4-methoxyphenyl-)amino group, etc.), an N-alkylanilino group (for example, an N-methylanilino group, an N-butylanilino group, etc.), an N-acylanilino group (for example, an N-acetylanilino group, an N-trichloroacetylanilino group, etc.), a hydroxy group, and a mercapto group, etc. When an alkyl group is substituted with a fluorine atom, the group may be the so-called polyfluoroalkyl group. Of the above substituents a halogen atom, an alkoxy group and an aryloxy group are preferred.

Examples of $R^1$ include a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, and a naphthyl group. Examples of $R^2$ include a methyl group, a butyl group, an octyl group, a hexadecyl group, a 2-chloroethyl group, and a 2-methoxyethyl group.

Among the cyan coupler residues represented by A, preferred residues are phenol cyan coupler residues represented by the following general formula (II).

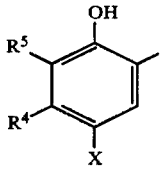

(II)

In the formula (II), $R^4$ represents an unsubstituted or substituted alkyl group, an unsubstituted or substituted alkylacylamino group, or an unsubstituted or substituted arylacylamino group, wherein the substituents are the same as those for the alkyl group represented by $R^1$ as described above. Examples of the alkyl group include a methyl group, an ethyl group, a butyl group, a pentadecyl group, a phenylthiomethyl group and a chloromethyl group. Examples of the alkylacylamino group include a butyrylamino group, a pivaloylamino group and a 2-(2',4'-di-tert-amylphenoxy)butanamido group. An example of the arylacylamino group includes a benzoylamino group. Of the above substituents a halogen atom, an alkoxy group and an aryloxy group are preferred.

$R^5$ represents a hydrogen atom, a halogen atom (a fluorine atom, a chlorine atom, a bromine atom, etc.). X represents a coupling-off group capable of being released upon oxidation coupling reaction with a developing agent (for example, a hydrogen atom, a halogen atom, an alkoxy group, an aryloxy group, an acyloxy group, an imido group, a sulfonamido group or a thiocyano group, etc.).

As a particularly preferred $R^4$, there is a substituted or unsubstituted alkylacylamino group.

Hydrogen is particularly preferred as $R^5$.

Of the compounds represented by the general formula (I), those in which the group represented by the formula

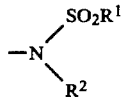

is substituted at the ortho position or the para position to the —NHCO— group are particularly preferred in view of the effects according to the present invention. Furthermore, those in which the group is substituted at the ortho position to the —NHCO— group are more preferred.

Examples of such couplers included in the scope of the present invention are described below, but the couplers are not limited thereto.

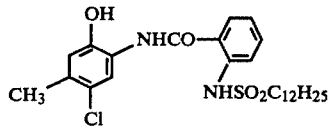

(1)

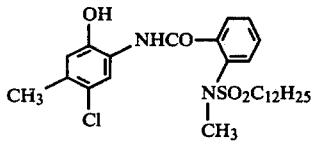

(2)

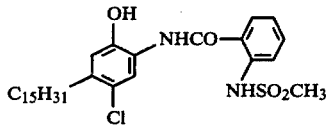

(3)

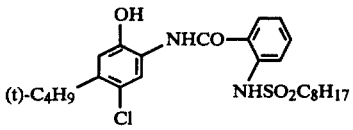

(4)

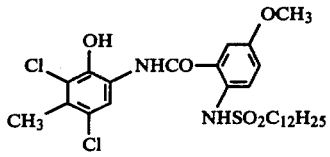

(5)

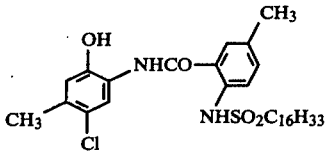

(6)

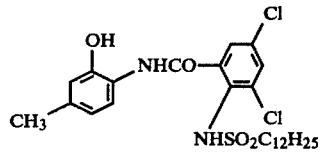

(7)

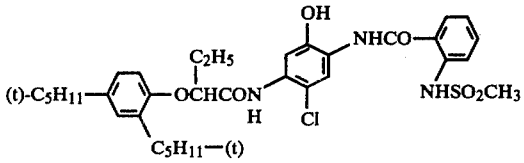

(8)

-continued (9)

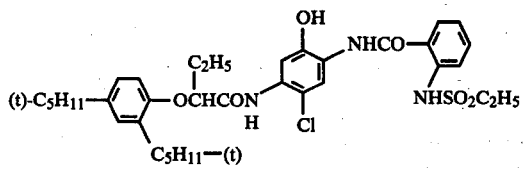

(10)

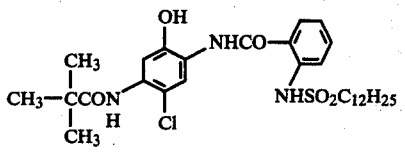

(11)

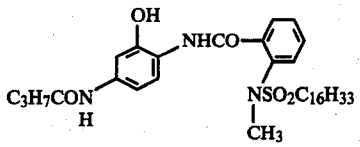

(12)

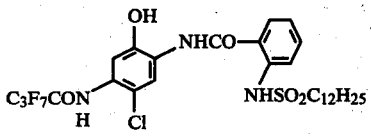

(13)

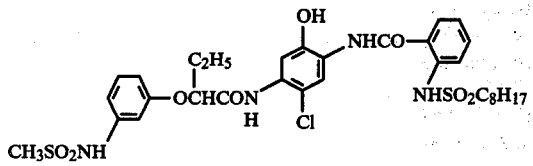

(14)

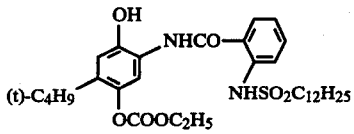

(15)

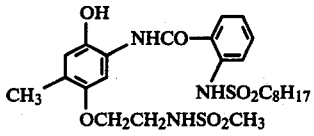

(16)

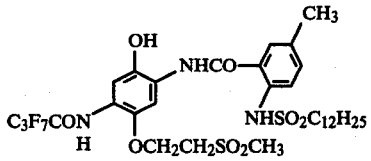

(17)

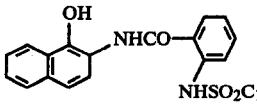

(18)

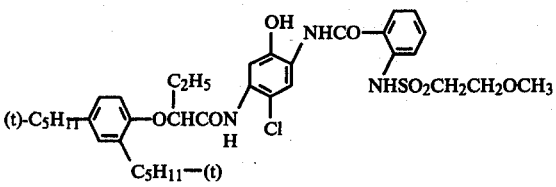

-continued (19)

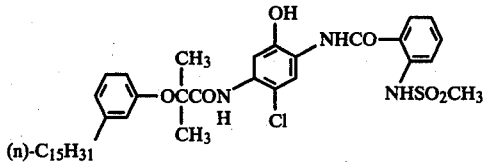

(20)

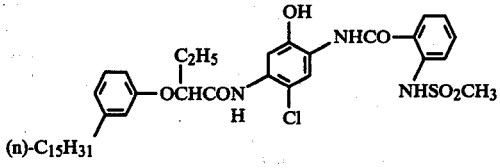

Of the above couplers, Couplers (1), (5), (8), (9), (12), (13), (17) to (20) are preferred. Couplers (5), (8), (9), (19) and (20) are most preferred.

It is surprising that the high fastness of color images is obtained by the use of the above described coupler solvent having a dielectric constant ranging from 2.5 to 5.

A particularly preferred dielectric constant of a coupler solvent is from 3.2 to 5.0.

Coupler solvents which can be used in the present invention include any known coupler solvent having a dielectric constant in the above described range. Examples of particularly preferred coupler solvents are shown below.

| | Coupler Solvent | Dielectric Constant |
|---|---|---|
| (A) | Tri-i-nonyl phosphate | 4.5 |
| (B) | Tri-i-decyl phosphate | 4.3 |
| (C) | Tri-i-dodecyl phosphate | 3.9 |
| (D) | Di-i-nonyl phthalate | 4.6 |
| (E) | Di-n-dodecyl phthalate | 4.2 |
| (F) | Di-i-octadecyl phthalate | 3.6 |
| (G) | Oleyl benzoate | 3.7 |

The ratio by weight of the coupler solvent to the coupler is from 0.01 to 2.0, preferably from 0.1 to 1.2, and more preferably from 0.2 to 0.8.

Particles of the coupler solution can be obtained using known methods, for example, by a method described in U.S. Pat. No. 2,322,027 incorporated herein by reference. For example, the coupler is dissolved together with the coupler solvent in an organic solvent having a boiling point of from 30° C. to 150° C. (for example, ethyl acetate, butyl acetate, ethyl propionate, etc.). The solution is then dispersed in an aqueous gelation solution together with a known surface active agent whereby the particles of the coupler solution disposed in gelatin are obtained.

Useful surface active agents include nonionic surface active agents such as saponin (steroid series), alkylene oxide derivatives (e.g., polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic acid polyglyceride, alkylphenol polyglyceride, etc.), fatty acid esters of polyhydric alcohols, sugar alkyl esters, etc.; anionic surface active agents containing acidic groups (such as carboxy group, sulfo group, phospho group, sulfuric ester group, phosphoric ester group, etc.) such as alkylcarboxylic acid salts, alkylsulfonic acid salts, alkylbenzenesulfonic acid salts, alkylnaphthalenesulfonic acid salts, alkylsulfuric esters, alkylphosphoric esters, N-acyl-N-alkyltaurines, sulfosuccinic esters, sulfoalkylpolyoxyethylene alkylphenyl ethers, polyoxyethylene alkylphosphates, etc.; amphoteric surface active agents such as amino acids, aminoalkylsulfonic acids, aminoalkylsulfuric or phosphoric esters, alkylbetaines, amine oxides, etc.; and cationic surface active agents such as alkylamines, aliphatic or aromatic quaternary ammonium salts, heterocyclic quaternary ammonium salts (e.g., pyridinium, imidazolium, etc.), aliphatic or hetero ring-containing phosphonium or sulfonium salts, etc.

The color photographic light-sensitive material of the present invention wherein a coupler of the general formula (I) in which the group represented by the formula

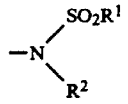

is substituted at the ortho position to the —NHCO— group and a coupler solvent having a dielectric constant of 3.2 to 5.0 may be combined in a mixture to obtain a more preferred embodiment with respect to the effects of the present invention. It is particularly preferred if the ratio by weight of the coupler solvent to the coupler is from 0.2 to 0.8.

According to the present invention it is important to use a coupler solvent having a dielectric constant of 2.5 to 5.0. Therefore, the objects of the present invention can be attained by using two or more coupler solvents as a mixture. However, the dielectric constant of the mixture of the solvents must be in the range of 2.5 to 5.0.

The above described couplers which can be used in the present invention can be synthesized by processes as described below.

Anthranilic acid ester is condensed with the corresponding sulfonic acid chloride, using pyridine or triethylamine as a deacidifying agent, to produce o-sulfonylaminobenzoic acid ester. If necessary, it is possible to carry out N-alkylation thereof, using an alkylhalide and a strong base such as sodium hydride. The resulting ester is hydrolyzed in the presence of alkali hydroxide to produce a benzoic acid derivative, which is then processed with thionyl chloride and phosphorus oxychloride to produce acid chloride. The resulting acid chloride and the corresponding 2-aminophenol derivative are refluxed in acetonitrile, by which o-sulfonamidobenzoylaminophenol can be synthesized.

In the case of synthesizing 2,5-diacylaminophenol derivatives, a 5-nitro derivative is first synthesized. After the nitro group is reduced to form an amino group, the product is reacted with another acid chloride to produce a coupler.

A photographic emulsion layer in the photographic light-sensitive material produced and utilized in accordance with the present invention may contain a color image forming coupler, i.e., a compound capable of forming a dye upon the reaction with the oxidation product of an aromatic amine (usually primary amine) developing agent (hereinafter referred to as a coupler), other than the coupler of the present invention. A non-diffusible coupler which contains as a hydrophobic group, a group called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor (the so-called DIR coupler) upon development can also be present therein. Furthermore, a coupler which provides a colorless product upon the coupling reaction can be employed.

Examples of known useful yellow color forming couplers include open chain ketomethylene type couplers. Among them, benzoylacetianilide type and pivaloylacetanilide type compounds are advantageously used. Examples of the yellow color forming couplers capable of being used include those described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77 (the term "OPI" as used herein refers to a "published unexamined Japanese patent application").

Examples of useful magenta color forming couplers include pyrazolone type compounds, indazolone type compounds and cyanoacetyl type compounds. The use of pyrazolone type compounds has been found to be particularly advantageous. Examples of the magenta color forming couplers capable of being used include those described in U.S. Pat. Nos. 2,600,788, 2,983,608, 3,062,653, 3,127,269, 3,311,476, 3,419,391, 3,519,429, 3,558,319, 3,582,322, 2,615,506, 3,834,908 and 3,891,445, West German Patent No. 1,810,464, West German Patent Application (OLS) Nos. 2,408,665, 2,417,945, 2,418,959 and 2,424,467, Japanese Patent Publication No. 6031/65 and Japanese Patent Application (OPI) Nos. 20826/76, 58922/77, 129538/74, 74027/74, 159336/75, 42121/77, 74028/74, 60233/75, 26541/76 and 55122/78.

Examples of useful cyan color forming couplers include phenol type compounds and naphthol type compounds. Specific examples of these compounds include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329 and Japanese Patent Application (OPI) Nos. 59838/73, 26034/76, 5055/73, 146828/76, 69624/77 and 90932/77.

Examples of useful colored couplers include those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77 and West German Patent Application (OLS) No. 2,418,959.

Examples of useful DIR couplers include those described in U.S. Pat. Nos. 3,227,554, 3,617,291, 3,701,783, 3,790,384 and 3,632,345, West German Patent Application (OLS) Nos. 2,414,006, 2,454,301 and 2,454,329, British Patent 953,454, Japanese Patent Application (OPI) Nos. 69624/77 and 122335/74 and Japanese Patent Publication No. 16141/76.

The light-sensitive materials may contain compounds releasing a development inhibitor other than the DIR couplers. For example, it is possible to use those described in U.S. Pat. Nos. 3,297,445 and 3,379,529, West German Patent Application (OLS) No. 2,417,914 and Japanese Patent Application (OPI) Nos. 15271/77 and 9116/78.

Two or more of the above described couplers may be contained in the same layer. The same compound may be contained in two or more layers.

These couplers are generally added in an amount of from $2\times10^{-3}$ mol to $5\times10^{-1}$ mol, and preferably from $1\times10^{-2}$ mol to $5\times10^{-1}$ mol, per mol of silver in the emulsion layer.

The above described couplers are incorporated in the silver halide emulsion layers by known methods, for example, by a method as described in U.S. Pat. No. 2,322,027 hereby incorporated by reference for the purpose of disclosing these methods. For example, they can be dispersed in a hydrophilic colloid after being dissolved in phthalic acid alkyl esters (for example, dibutyl phthalate or dioctyl phthalate, etc.), phosphoric acid esters (for example, triphenyl phosphate, tricresyl phosphate, dioctylbutyl phosphate, etc.), citric acid esters (for example, tributyl acetylcitrate, etc.), benzoic acid esters (for example, octyl benzoate, etc.), alkylamides (for example, diethyl laurylamide, etc.) or aliphatic acid esters (for example, dibutoxyethyl succinate, dioctyl azelate, etc.), etc., or organic solvents having a boiling point of from about 30° C. to 150° C. Examples include a lower alkyl acetate such as ethyl acetate or butyl acetate, ethyl pripionate, secondary butyl alcohol, methyl isobutyl ketone, δ-ethoxyethyl acetate or methyl Cellosolve acetate, etc. The above described high boiling point organic solvents and low boiling point organic solvents may be used in mixtures thereof.

Furthermore, it is possible to use a dispersing method using polymers, as described in Japanese Patent Publication No. 39853/76 and Japanese Patent Application (OPI) No. 59943/76.

Couplers which have acid groups such as a carboxylic acid group or a sulfonic acid group are incorporated in the hydrophilic colloid in the form of an alkaline aqueous solution.

In the light sensitive materials produced by the present invention, the hydrophilic colloid layers may contain an ultraviolet ray absorbing agent. For example, it is possible to use benzotriazole compounds substituted by aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid ester compounds (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455). Further, it is possible to use those described in U.S. Pat. No. 3,499,762 and Japanese Patent Application (OPI) No. 48535/79. Ultraviolet ray absorbing couplers (for example, α-naphthol type cyan dye forming couplers) or ultraviolet ray absorbing polymers may also be used. These ultraviolet ray absorbing agents may be mordanted in a specified layer.

The photographic emulsions used in the present invention can be prepared by processes as described in *Chimie et Physique Photographique,* by P. Glafkides (published by Paul Montel Co., 1967); *Photographic Emulsion Chemistry,,* by G. F. Duffin (published by The Focal Press Co., 1966); and *Making and Coating Photographic Emulsion,* by V. L. Zelikman et al (published by The Focal Press Co., 1964). More specifically, any acid process, neutral process or ammonia process may be used. Further, as a type of reaction of a soluble silver salt with a soluble halogen salt, any single jet mixing process, double jet mixing process, or combination thereof may be used.

It is also possible to use a process of forming particles in a presence of excess silver ions (a so-called reverse mixing process). One type of simultaneous mixing process is a process which comprises maintaining a constant pAg of a liquid phase while forming silver halide (the so-called controlled double jet process).

According to this process, silver halide emulsions wherein the crystal form is regular and the particle size is nearly uniform are obtained.

Two or more silver halide emulsions prepared separately may be used as a mixture thereof, if desired.

Cadmium salts, zinc salts, lead salts, thallium salts, iridium salts or complex salts thereof, rhodium salts or complex salts thereof and iron salts or complex salts thereof, etc., may be incorporated in the step of forming silver halide particles or of physical ageing.

As a binder or a protective colloid in the photographic emulsions, gelatin is advantageously used, but hydrophilic colloids other than gelatin can also be used. For example, it is possible to use proteins such as gelatin derivatives, graft polymers of gelatin with another high molecular substance, albumin or casein, etc.; saccharides such as cellulose derivatives such as hydroxyethyl cellulose, carboxymethyl cellulose or cellulose sulfate, etc., sodium alginate or starch derivatives, etc.; and various synthetic hydrophilic high molecular materials such as homopolymers or copolymers including polyvinyl alcohol, polyvinyl alcohol semiacetal, poly-N-vinylpyrrolidone, polyacrylic acid, polymethacrylic acid, polyacrylamide, polyvinylimidazole and polyvinylpyrazole, etc.

Useful gelatins include not only lime-processed gelatin, but also acid-processed gelatin and enzyme-processed gelatin, as described in *Bull. Soc. Sci. Phot. Japan,* No. 16, page 30 (1966). Further, hydrolysis products and enzymatic decomposition products of gelatin can be used. Examples of useful gelatin derivatives include those which are obtained by reacting gelatin with various compounds, for example, acid halides, acid anhydrides, isocyanates, bromoacetic acid, alkane sultones, vinyl sulfonamides, maleinimide compounds, polyalkylene oxides and epoxy compounds. Examples of them have been described in U.S. Pat. Nos. 2,614,928, 3,132,945, 3,186,846 and 3,312,553, British Pat. Nos. 861,414, 1,033,189 and 1,005,784 and Japanese Patent Publication No. 26845/67, etc.

Examples of useful graft polymers of gelatin include those obtained by grafting gelatin with homo- or copolymers of vinyl monomers such as acrylic acid, methacrylic acid and derivatives thereof such as esters or amides, etc., acrylonitrile or styrene, etc. Particularly, it is preferred to use graft polymers of gelatin with polymers having some degree of compatibility with gelatin, for example, polymers of acrylic acid, methacrylic acid, acrylamide, methacrylamide or hydroxyalkyl methacrylate, etc. Examples thereof have been described in U.S. Pat. Nos. 2,763,625, 2,831,767 and 2,956,884.

Typical examples of the synthetic high molecular materials are those described in West German Patent Application (OLS) No. 2,312,708, U.S. Pat. Nos. 3,620,751 and 3,879,205 and Japanese Patent Publication No. 7561/68.

For the purpose of preventing fogging in the step of producing light-sensitive materials, during preservation or during photographic processing or to stabilize photographic properties, it is possible to add various compounds to the photographic emulsions used in the present invention. Namely, it is possible to add many compounds known as anti-fogging agents or stabilizing agents such as azoles. Some specific examples include benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazole and mercaptotetrazoles (particularly, 1-phenyl-5-mercaptotetrazole), etc.; mercaptopyrimidines; mercaptotriazines; thioketo compounds such as oxazolinethione; azaindenes, for example, triazaindenes, tetraazaindenes (particularly, 4-hydroxy substituted-(1,3,3a,7)-tetraazaindenes) and pentaazaindenes, etc.; benzenethiosulfonic acids, benzenesulfinic acids and benzenesulfonic acid amides, etc. For example, it is possible to use compounds as described in U.S. Pat. Nos. 3,954,474 and 3,982,947 and Japanese Patent Publication No. 28660/77.

For the purpose of increasing sensitivity, increasing contrast, or accelerating development, the photographic emulsion layers of the photographic light-sensitive materials of the present invention may contain, for example, polyalkylene oxide or derivatives thereof such as ethers, esters or amines, etc., thioether compounds, thiomorpholinic acid, quaternary ammonium salts, urethane derivatives, urea derivatives, imidazole derivatives and 3-pyrazolidones, etc. For example, it is also possible to use compounds as described in U.S. Pat. Nos. 2,400,532, 2,423,549, 2,716,062, 3,617,280, 3,772,021 and 3,808,003 and British Pat. No. 1,488,991, etc., for these purpose.

The photographic emulsions used in the present invention may be spectrally sensitized with methine dyes or other dyes. Useful dyes include cyanine dyes, merocyanine dyes, complex cyanine dyes, complex merocyanine dyes, holopolar cyanine dyes, hemicyanine dyes, styryl dyes and hemioxonol dyes. Particularly suitable dyes are dyes belonging to cyanine dyes, merocyanine dyes and complex merocyanine dyes. These dyes may have as a basic heterocyclic nucleus any nuclei utilized generally for cyanine dyes. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, etc.; nuclei wherein an alicyclic hydrocarbon ring is condensed with the above described nuclei; and nuclei wherein an aromatic hydrocarbon ring is condensed with the above described nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus, etc. These nuclei may have substituents on the carbon atoms.

In the merocyanine dyes and the complex merocyanine dyes, it is possible to utilize a nucleus having ketomethylene structure such as a 5- or 6-membered heterocyclic nucleus. More specifically, it is possible to use a pyrazolin-5-one nucleus, a thiohydantion nucleus, a 2-thioxazolidine-2,4-dione nucleus, a thiazolidine-2,4-dione nucleus, a rhodanine nucleus or a thiobarbituric acid nucleus, etc.

Examples of useful sensitizing dyes are those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes can be used alone, or in combination. The combinations of the sensitizing dyes are often used for, particularly, the purpose of supersensitization. Typical examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese patent Publication Nos. 4936/68 and 12375/78 and Japanese Patent Application (OPI) Nos. 110618/77 and 109925/77.

The emulsions may contain dyes which do not have a spectral sensitization function themselves or substances which do not substantially absorb visible rays, but show a supersensitization function, together with the sensitizing dyes. For example, they may contain aminostilbene compounds substituted with a nitrogen containing heterocyclic group (for example, U.S. Pat. Nos. 2,933,390 and 3,635,721), aromatic organic acid-formaldehyde condensates (for example, U.S. Pat. No. 3,743,510), cadmium salts or azaindene compounds, etc. Combinations described in U.S. Pat. Nos. 3,615,613, 3,615,641, 3,617,295 and 3,635,721 are particularly preferred.

In the light-sensitive materials produced in accordance with the present invention, the hydrophilic colloid layers may contain water-soluble dyes as filter dyes or for the purpose of preventing irradiation. Such dyes include oxonol dyes, hemioxonol dyes, styryl dyes, merocyanine dyes, cyanine dyes and azo dyes. Particularly, oxonol dyes, hemioxonol dyes and merocyanine dyes are preferred. Examples of such dyes capable of being used include those described in British Pat. Nos. 584,609 and 1,177,429, Japanese Patent Application (OPI) Nos. 85130/73, 99620/74, 114420/74 and 108115/77 and U.S. Pat. Nos. 2,274,782, 2,533,472, 2,956,879, 3,148,187, 3,177,078, 3,247,127, 2,540,887, 3,575,704, 3,653,905, 3,718,472, 4,071,312 and 4,070,352.

In the light-sensitive materials produced in accordance with the present invention, photographic emulsion layers and other hydrophilic colloid layers may contain whitening agents such as stilbene, triazine, oxazole or coumarin type whitening agents. These whitening agents may be soluble in water. In the case of water-insoluble whitening agents, they may be used as a dispersion. Examples of fluorescent whitening agents have been described in U.S. Pat. Nos. 2,632,701, 3,269,840 and 3,359,102 and British Pat. Nos. 852,075 and 1,319,763, etc.

When the present invention is carried out, known antifading agents may be used therewith. Furthermore, the color image stabilizers may be used in the light-sensitive materials according to the present invention, alone or as a mixture of two or more of them. The antifading agents include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, etc., gallic acid derivatives as described in U.S. Pat. Nos. 3,457,079 and 3,069,262, etc., p-alkoxyphenols as described in U.S. Pat. Nos.

2,735,765 and 3,698,909 and Japanese Patent Publication Nos. 20977/74 and 6623/77, p-oxyphenol derivatives as described in U.S. Pat. Nos. 3,432,300, 3,573,050, 3,574,627 and 3,764,337 and Japanese Patent Application (OPI) Nos. 35633/77, 147434/77 and 152225/77, and bisphenols as described in U.S. Pat. No. 3,700,455.

The light-sensitive materials according to the present invention may contain hydroquinone derivatives, aminophenol derivatives, gallic acid derivatives or ascorbic acid derivatives as anti-color-fogging agents. Examples thereof are described in U.S. Pat. Nos. 2,360,290, 2,336,3217, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75, etc.

The present invention can be applied to multilayer multicolor photographic materials comprising layers of at least two different spectral sensitivities on a base. The multilayer technicolor photographic materials generally have at least a red-sensitive emulsion layer, a green-sensitive emulsion layer, and a blue-sensitive emulsion layer on a base. The order of these layers can be suitably selected as occasion demands. Generally, the red-sensitive emulsion layer contains a cyan forming coupler, the green-sensitive emulsion layer contains a magenta forming coupler, and the blue-sensitive emulsion layer contains a yellow forming coupler, but other combinations can be adopted if desired.

In the photographic light-sensitive materials produced according to the present invention, the photographic emulsion layers and other layers are produced by applying to a flexible base, such as conventionally used plastic films, paper or cloth, etc., or rigid bases such as glass, porcelain or metal, etc. As useful elastic bases, there are films composed of semisynthetic or synthetic high molecular materials such as cellulose nitrate, cellulose acetate, cellulose acetate butyrate, polystyrene, polyvinyl chloride, polyethylene terephthalate or polycarbonate, etc., and papers to which a baryta layer or $\alpha$-olefin polymer (for example, polyethylene, polypropylene or ethylene-butene copolymer) is applied or laminated. The bases may be colored with dyes or pigments. In order to intercept light, the bases may be blackened. The surface of these bases is generally subjected to an undercoating treatment in order to improve adhesion to the photographic emulsion layer, etc. The surface of the bases may be subjected to corona discharging, ultraviolet ray application or flame treatment, etc., before or after the undercoating treatment. Further, the present invention can be used for color light-sensitive materials comprising a layer having low oxygen permeability (for example, a layer composed of polyvinyl alcohol or homopolymer or copolymer of acrylonitrile, etc.) between the base and the photographic emulsion layer.

Photographic processing of the light-sensitive materials of the present invention can be carried out by known processes. Known processing solutions can be used. The processing temperature is generally selected from the range from 18° C. to 50° C., but a temperature lower than 18° C. or a temperature higher than 50° C. may be used. Known development processes for forming silver images (black-white photographic processing) and development processing for forming dye images may be adopted as the color photographic processing, according to the particular purpose.

The color developing solution generally consists of an alkaline aqueous solution containing a color developing agent. As the color developing agent, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline, etc.).

In addition, compounds described in *Photographic Processing Chemistry*, pages 226 to 229, by L. F. A. Mason (published by Focal Press, 1966), U.S. Pat. Nos. 2,193,015 and 2,592,364 and Japanese Patent Application (OPI) No. 64933/73, etc., may be used.

The color developing solution is capable of containing pH buffers such as sulfites, carbonates, borates or phosphates of alkali metals, and development restrainers or anti-fogging agents such as bromides, iodides or organic anti-fogging agents. Furthermore, if desired, the solution may contain water softeners, preservatives such as hydroxylamine, organic solvents such as benzyl alcohol or diethylene glycol, development accelerators such as polyethylene glycol, quaternary ammonium salts or amines, dye forming couplers, competition couplers, fogging agents such as sodium borohydride, auxiliary developing agents such as 1-phenyl-3-pyrazolidone, viscosity-imparting agents, polycarboxylic acid chelating agents as described in U.S. Pat. No. 4,083,723 and antioxidants as described in West German Patent Application (OLS) No. 2,622,950, etc.

The photographic emulsion layers after color development are generally subjected to bleaching. The bleaching may be carried out simultaneously with fixing or may be carried out respectively. As bleaching agents, compounds of polyvalent metals such as iron (III), cobalt (IV), chromium (VI) or copper (II), etc., peracids, quinones and nitroso compounds are used. For example, it is possible to use ferricyanides, bichromates, organic complex salts of iron (III) or cobalt (III) and complex salts of aminopolycarboxylic acids such as ethylenediaminetetraacetic acid, nitrilotriacetic acid or 1,3-diamino-2-propanol tetraacetic acid, etc., or organic acids such as citric acid, tartaric acid or malic acid, etc.; persulfates and permanganates; and nitrosophenol, etc. Among them, potassium ferricyanide, sodium (ethylenediaminetetraacetato)iron (III) complex and ammonium (ethylenediaminetetraacetato)iron (III) complex are particularly useful. (Ethylenediaminetetraacetato)iron (III) complex salts are useful for both a bleaching solution or a non-bath bleach-fixing solution.

To the bleaching solution or the bleach-fixing solution, it is possible to add various additives in addition to bleaching accelerators as described in U.S. Pat. Nos. 3,042,520 and 3,241,966 and Japanese Patent Publication Nos. 8506/70 and 8836/70, etc., and thiol compounds described in Japanese Patent Application (OPI) No. 65732/78.

In the following, the present invention is illustrated in detail by examples, but the invention is not limited thereto.

EXAMPLE 1

A solution obtained by heating 25 g of Coupler (20) according to the present invention: 4-chloro-2-(2-methylsulfonamidobenzoylamino)-5-[2-(3-n-pentadecylphenoxy)butanoylamino]phenol, 15 g of Coupler Solvent (B) [ratio by weight of coupler solvent-/coupler=0.6] and 50 ml of ethyl acetate to 50° C. was added to 250 ml of an aqueous solution containing 25 g of gelatin and 1.0 g of sodium dodecylbenzenesulfonate. The mixture was stirred and allowed to pass 5 times through a colloid mill heated previously, by which the mixture was finely dispersed to obtain an emulsion.

The whole of this emulsion was added to 1.0 kg of a photographic emulsion containing 54 g of silver iodobromide and 60 g of gelatin. After 80 ml of a 2% aqueous solution of 4,6-dichloro-4-hydroxytriazine as a hardening agent was added, a pH of the mixture was adjusted to 6.0 and the mixture was applied to a cellulose triacetate film base so as to obtain a dry film thickness of 7.0 microns. The resulting film was designated as Sample A.

Films were prepared by the same procedure as described above, except using the same amounts of Coupler Solvents (E) and (G) as Coupler Solvent (B) instead of the above described Coupler Solvent (B). These films were designated as Samples B and C, respectively.

Furthermore, for purpose of comparison, a film was prepared by the same procedure as described above, except using an equimolar amount of Comparative Coupler (101) as described below instead of the above described Coupler (20) and using Coupler Solvent (B) in an amount such that the ratio by weight of coupler solvent/coupler was 0.6. This film was designated as Sample D. Also, films were prepared by the same procedure as described above using Coupler (20), except using Comparative Coupler Solvents (a) and (b) as described below instead of the above described Coupler Solvent (B) in an amount of a ratio by weight of coupler solvent/coupler being 0.6. These films were designated as Samples E and F.

Comparative Coupler (101):

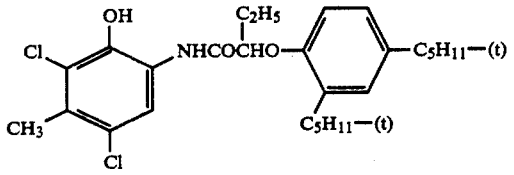

Comparative Coupler Solvent (a):

Di-n-butyl phthalate (dielectric constant: 6.5)

Comparative Coupler Solvent (b):

Liquid paraffin (dielectric constant: 2.2)

These films were subjected to a continuous exposure by means of a sensitometric wedge and processed thereafter as follows.

Color Development Processing Step:

| | | |
|---|---|---|
| 1. Color development | 33° C. | 3 min 30 sec |
| 2. Bleach-fixing | 33° C. | 1 min 30 sec |
| 3. Water washing | 25 to 30° C. | 2 min 30 sec |

The composition of each processing solution for the color development processing step was as follows.

Color Developing Solution:

| | |
|---|---|
| Benzyl alcohol | 15 ml |
| Diethylene glycol | 8 ml |
| Ethylenediaminetetraacetic acid | 5 g |
| Sodium sulfite | 2 g |

-continued

| | |
|---|---|
| Anhydrous potassium carbonate | 30 g |
| Hydroxylamine sulfate | 3 g |
| Potassium bromide | 0.6 g |
| 4-Amino-N—ethyl-N—(β-methanesulfonamidoethyl)-m-toluidine sesquisulfate monohydrate | 5 g |
| Water to make | 1 l |
| | pH 10.2 |

Bleach-Fixing Solution:

| | |
|---|---|
| Ethylenediaminetetraacetic acid (Ethylenediaminetetraacetato)iron (III) complex | 2 g |
| | 40 g |
| Sodium sulfite | 5 g |
| Ammonium thiosulfate | 70 g |
| Water to make | 1 l |

The fastness to heat and light of each film after processing was examined. Fastness to heat was determined by allowing the film to remain at 100° C. for 6 days in the dark, and fastness to light was determined by exposing the film to light for 6 days by means of a xenon tester (100,000 lux). The results are described in Table 1 as reduction ratios of the density based on an initial density of 1.0.

TABLE 1

| Film Sample | Coupler | Coupler Solvent | Dielectric Constant | 100° C., for 6 Days | Xenon, for 6 Days |
|---|---|---|---|---|---|
| A | (20) | (B) | 4.3 | 100 | 93 |
| B | (20) | (E) | 4.2 | 99 | 89 |
| C | (20) | (G) | 3.7 | 100 | 90 |
| D | (101) | (B) | 4.3 | 35 | 85 |
| E | (20) | (a) | 6.5 | 98 | 78 |
| F | (20) | (b) | 2.2 | 96 | 73 |

As is apparent from the results shown in Table 1 above, Sample D is resistant to light to some extent but is extremely weak to heat while Samples E and F are resistant to heat but is weak to light. On the other hand, Samples A, B and C containing the particles of the coupler solution according to the present invention are excellent in fastness to both of heat and light in comparison with Samples D, E and F for comparison.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing particles of a coupler solution, comprising a cyan dye forming coupler represented by the following general formula (I)

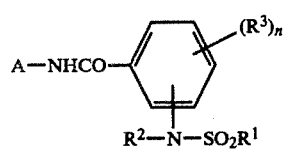

(I)

wherein A represents a cyan coupler residue, and the —NHCO— group does not bond to A in the active position of A; $R^1$ represents a substituted or unsubstituted alkyl group or a substituted or unsubstituted aryl group; $R^2$ represents a hydrogen atom or a substituted or unsubstituted alkyl group; $R^3$ represents a hydrogen atom, a halogen atom, an alkyl group or an alkoxy group; and n represents an integer of 1 to 3, and when n is 2 or more $R^3$ may be the same or different, and a coupler solvent having a dielectric constant of 2.5 to 5.

2. The silver halide color photographic light-sensitive material as claimed in claim 1, wherein the alkyl group represented by $R^1$ is an alkyl group having from 1 to 22 carbon atoms.

3. The silver halide color photographic light-sensitive material as claimed in claim 1, wherein the aryl group represented by $R^1$ is an aryl group having from 6 to 22 carbon atoms.

4. The silver halide color photographic light-sensitive material as claimed in claim 1, wherein the alkyl group represented by $R^2$ is an alkyl group having from 1 to 22 carbon atoms.

5. The silver halide color photographic light-sensitive material as claimed in claim 1, wherein the alkyl group represented by $R^3$ is an alkyl group having from 1 to 22 carbon atoms.

6. The silver halide color photographic light-sensitive material as claimed in claim 1, wherein the substituents of the alkyl groups and aryl groups represented by $R^1$ and $R^2$ are selected from a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

7. The silver halide color photographic light-sensitive material as claimed in claim 6, wherein the substituent of the alkyl groups and aryl groups represented by $R^1$ and $R^2$ is a halogen atom, an alkoxy group or an aryloxy group.

8. The silver halide color photographic light-sensitive material as claimed in claim 1, wherein $R^1$ is a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, or a naphthyl group; and $R^2$ is a methyl group, a butyl group, an octyl group, a hexadecyl group, a 2-chloroethyl group, or a 2-methoxyethyl group.

9. The silver halide color photographic light-sensitive material as claimed in claim 1, wherein A represents a phenol cyan coupler residue represented by the following general formula (II):

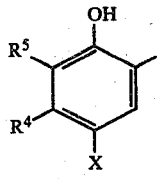

(II)

wherein $R^4$ represents an unsubstituted or substituted alkyl group, an unsubstituted or substituted alkylacylamino group or an unsubstituted or substituted arylacylamino group; $R^5$ represents a hydrogen atom or a halogen atom; and X represents a coupling-off group capable of being released by an oxidation coupling reaction with a developing agent.

10. The silver halide color photographic light-sensitive material as claimed in claim 9, wherein $R^4$ is an unsubstituted or substituted alkylacylamino group.

11. The silver halide color photographic light-sensitive material as claimed in claim 9, wherein $R^5$ is a hydrogen atom.

12. The silver halide color photographic light-sensitive material as claimed in claim 9, wherein the substituents of $R^4$ are selected from a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

13. The silver halide color photographic light-sensitive material as claimed in claim 12, wherein the substituent of the alkyl groups, alkylacylamino groups and arylacylamino groups represented by $R^4$ is a halogen atom, an alkoxy group or an aryloxy group.

14. The silver halide color photographic light-sensitive material as claimed in claim 9, wherein X represents a hydrogen atom, a halogen atom, an alkoxy group, an aryloxy group, an acyloxy group, an imido group, a sulfonamido group or a thiocyano group.

15. The silver halide color photographic light-sensitive material as claimed in claim 9, wherein the alkyl group represented by $R^4$ is selected from a methyl group, an ethyl group, a butyl group, a pentadecyl group, a phenylthiomethyl group, and a chloromethyl group; the alkylacylamino group represented by $R^4$ is selected from a butyrylamino group, a pivaloylamino group and a 2-(2',4'-di-tert-amylphenoxy)butanamido group; and the arylacylamino group represented by $R^4$ is a benzoylamino group.

16. The silver halide color photographic light-sensitive material as claimed in claim 1, wherein the group represented by the formula

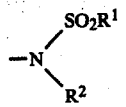

is substituted at the ortho position or the para position to the —NHCO— group.

17. The silver halide color photographic light-sensitive material as claimed in claim 1, wherein the group represented by the formula

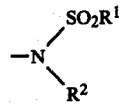

is substituted at the ortho position to the —NHCO— group.

18. The silver halide color photographic light-sensitive material as claimed in claim 1, wherein the cyan dye forming coupler is selected from the compounds:

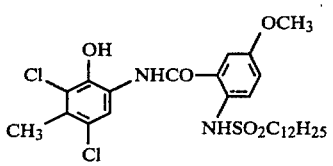

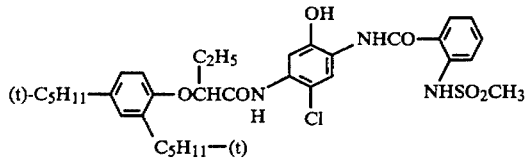

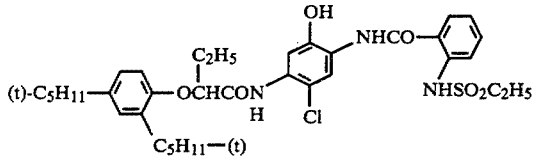

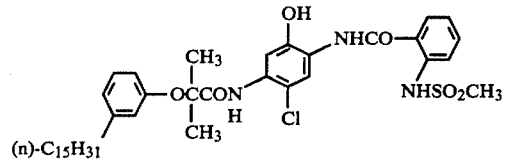

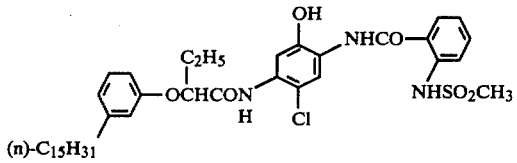

19. The silver halide color photographic light-sensitive material as claimed in claim 1, wherein the coupler solvent has a dielectric constant of 3.2 to 5.0.

20. The silver halide color photographic light-sensitive material as claimed in claim 1, wherein the coupler solvent is selected from tri-i-nonyl phosphate, tri-i-decyl phosphate, tri-i-dodecyl phosphate, di-i-nonyl phthalate, di-n-dodecyl phthalate, di-i-octadecyl phthalate and oleyl benzoate.

21. The silver halide color photographic light-sensitive material as claimed in claim 1, wherein a ratio by weight of the coupler solvent to the coupler is from 0.01 to 2.0.

22. The silver halide color photographic light-sensitive material as claimed in claim 1, wherein a ratio by weight of the coupler solvent to the coupler is from 0.1 to 1.2.

23. The silver halide color photographic light-sensitive material as claimed in claim 1, wherein a ratio by weight of the coupler solvent to the coupler is from 0.2 to 0.8.

24. The silver halide color photographic light-sensitive material as claimed in claim 17, wherein the coupler solvent has a dielectric constant of 3.2 to 5.0.

25. The silver halide color photographic light-sensitive material as claimed in claim 24, wherein a ratio by weight of the coupler solvent to the coupler is from 0.2 to 0.8.

26. The silver halide color photographic light-sensitive material as claimed in claim 1, comprising a light-sensitive silver halide emulsion layer containing particles of the coupler solution.

27. The silver halide color photographic light-sensitive material as claimed in claim 1, comprising a red-sensitive silver halide emulsion layer containing particles of the coupler solution.

28. A silver halide color photographic light-sensitive material comprising a support having thereon at least two light-sensitive silver halide emulsion layers having different spectral sensitivities, said photographic light-sensitive material containing particles of a coupler solution comprising a cyan dye forming coupler represented by the following general formula (I)

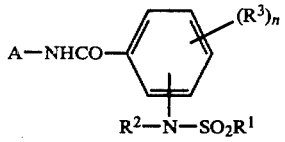

(I)

wherein A represents a cyan coupler residue, and the —NHCO— group does not bond to A in the active position of A; $R^1$ represents a substituted or unsubstituted alkyl group or a substituted or unsubstituted aryl group; $R^2$ represents a hydrogen atom or a substituted or unsubstituted alkyl group; $R^3$ represents a hydrogen atom, a halogen atom, an alkyl group or an alkoxy group; and n represents an integer of 1 to 3, and when n is 2 or more $R^3$ may be the same or different, and a coupler solvent having a dielectric constant of 2.5 to 5.

29. A silver halide color photographic light-sensitive material comprising a support having thereon a red-sensitive silver halide emulsion layer containing particles of a coupler solvent comprising a cyan dye forming coupler represented by the following general formula (I)

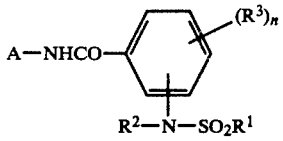

(I)

wherein A represents a cyan coupler residue, and the —NHCO— group does not bond to A in the active position of A; $R^1$ represents a substituted or unsubstituted alkyl group or a substituted or unsubstituted aryl group; $R^2$ represents a hydrogen atom or a substituted or unsubstituted alkyl group; $R^3$ represents a hydrogen atom, a halogen atom, an alkyl group or an alkoxy group; and n represents an integer of 1 to 3, and when n is 2 or more $R^3$ may be the same or different, and a coupler solvent having a dielectric constant of 2.5 to 5 at least one green-sensitive silver halide emulsion layer containing a magenta color forming coupler and at least one blue-sensitive silver halide emulsion layer containing a yellow color forming coupler.

* * * * *

UNITED STATES PATENT AND TRADEMARK OFFICE

CERTIFICATE OF CORRECTION

PATENT NO. : 4,455,367

DATED : June 19, 1984

INVENTOR(S) : Yoshio Seoka et al.

It is certified that error appears in the above-identified patent and that said Letters Patent is hereby corrected as shown below:

The term of this patent subsequent to June 8, 1999 has been disclaimed.

Signed and Sealed this

Ninth Day of February, 1988

*Attest:*

DONALD J. QUIGG

*Attesting Officer*

*Commissioner of Patents and Trademarks*